US005334913A

United States Patent [19]

Ury et al.

[11] Patent Number: 5,334,913

[45] Date of Patent: Aug. 2, 1994

[54] MICROWAVE POWERED LAMP HAVING A NON-CONDUCTIVE REFLECTOR WITHIN THE MICROWAVE CAVITY

[75] Inventors: Michael G. Ury, Bethesda; Charles H. Wood, Rockville, both of Md.

[73] Assignee: Fusion Systems Corporation, Rockville, Md.

[21] Appl. No.: 3,562

[22] Filed: Jan. 13, 1993

[51] Int. Cl.[5] ..... H05B 41/16

[52] U.S. Cl. ..... 315/248; 315/39; 315/344; 315/111.81; 313/607; 313/234

[58] Field of Search ..... 315/248, 39, 344, 111.81; 313/607, 234

[56] References Cited

U.S. PATENT DOCUMENTS

| | | | |
|---|---|---|---|
| 5,013,959 | 5/1991 | Kogelschatz | 315/248 X |
| 5,039,918 | 8/1991 | Ohtake et al. | 315/248 |
| 5,187,412 | 2/1963 | El-Hamamsy et al. | 315/248 |

*Primary Examiner*—Robert J. Pascal
*Assistant Examiner*—Reginald A. Ratliff
*Attorney, Agent, or Firm*—Pollock, Vande Sande & Priddy

[57] ABSTRACT

A microwave-powered discharge lamp having a microwave cavity, a discharge lamp mounted within the cavity, a reflector for light emitted by the lamp mounted outside the cavity, and a non-conductive reflector mounted within the cavity for outwardly reflecting light emitted from the lamp.

9 Claims, 1 Drawing Sheet

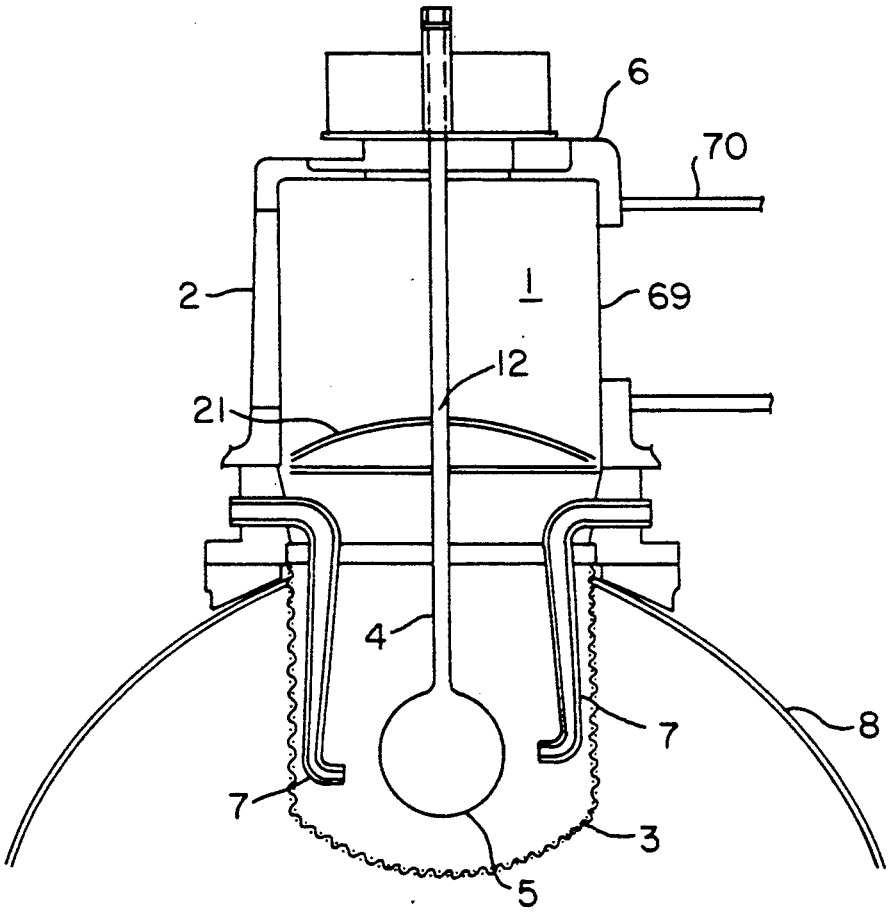
6
70
2
1
69
12
21
4
7
8
7
3
5

MICROWAVE POWERED LAMP HAVING A NON-CONDUCTIVE REFLECTOR WITHIN THE MICROWAVE CAVITY

FIELD OF THE INVENTION

This invention is related to microwave-powered electrodeless lamps.

BACKGROUND OF THE INVENTION

Microwave powered discharge lamps in which a light emitting discharge contained in an envelope is maintained by microwave excitation without electrodes are known in the discharge lamp art. Generally the microwave lamp comprises a microwave cavity to which microwave energy is coupled, and a transparent discharge envelope mounted inside the cavity.

A known type of microwave electrodeless lamp, termed reflectorless, is characterized in that an optical reflector used to control light emissions is not a wall of the cavity but is a separate part. For example, the cavity may be a cylindrical cavity the length of which is about twice the diameter, and is composed of two cup-like members joined together at their open ends. The first member may be formed of a layer of aluminum and comprises a cylindrical wall, a flat wall closing one end of the cylinder, and an open end. The second member is formed of a mesh, such as a reinforced tungsten mesh, and comprises a cylindrical wall, either a flat or spherical piece of mesh capping one end of the cylinder and an open end, the edges of which are joined to the edges of the open end of the first member. The flat wall of the first member may be removably secured to the cylindrical wall by conventional means such as machine screws. This provides access to the cavity for removal of the envelope, etc. The first member is provided with one or more coupling slots which run axially with respect to the cylinder on the cylindrical wall. The slots are used for coupling energy from a microwave source to the cavity, and will be discussed below.

A reflector, the axis of symmetry of which is approximately coincident with the axis of the cavity, surrounds the cavity. The surface of the reflector may follow a simple geometric surface such as an ellipsoid or a paraboloid, and it may be comprised of a plurality of annular facets each of which is sized and oriented so as to direct the light reflected by it in a desired direction, or it may be otherwise shaped as known in the reflector art.

A bulb is located on the axis of the cavity toward the end of the mesh of the second member. The bulb is comprised of an envelope portion and a stem which is located along the axis of the cavity and is fastened to the flat wall of the first member. Since the light source is energized by microwaves, the light it produces is emitted with significant power in all directions. The bulb is located well within the mesh; consequently, in excess of half of the solid angle about the bulb corresponds to the mesh.

However, a second portion of the solid angle about the bulb corresponds to the first member of the cavity, and light directed toward the first member of the cavity is for all intents and purposes lost.

SUMMARY OF THE INVENTION

It is an object of the present invention to provide an improved microwave-powered electrodeless lamp.

Other objects will become apparent from the accompanying drawing and the following detailed description.

In accordance with the present invention, there is provided a microwave-powered lamp comprising: a microwave cavity having a wall which is transparent to optical radiation; means for coupling microwave energy to the cavity; a discharge envelope mounted within the cavity for activation by microwaves; a reflecting means for reflecting light emitted from the cavity mounted outside the cavity, and a non-conductive reflector mounted within the cavity for reflecting light outwardly.

The present invention recovers and effectively utilizes light which is directed to walls of a cavity which are not transparent to and do not reflect light.

BRIEF DESCRIPTION OF THE FIGURE

The Figure is a secontional view of a preferred embodiment of this invention.

DETAILED DESCRIPTION OF THE PREFERRED EMBODIMENT

Referring to the Figure, lamp cavity 1 is dimensioned to support a mode of microwave oscillation approximating the cylindrical $TE_{111}$ mode at 2.45 GHz. Lamp cavity 1 is comprised of a first member 2 which is solid, preferably cast aluminum, and a second member 3 which is a mesh for retaining microwaves in the lamp cavity while permitting light to exit. The mesh may, for example, be woven with 0.005" wires at a density of 24 wires per inch in the weft and in the warp. The first member 2 and second member 3 may be fastened together so as to form a cylindrical cavity 1, by any suitable mechanical means, preferably by means of flanges ( not shown ).

A bulb comprised of a stem 4 and an envelope 5 depending therefrom is located on the axis of the cavity. The stem 4 is supported at the end 6 of the first member 2. The end 6 of the first member 2 may be removable so as to allow the bulb to be easily removed from the cavity 1 without removing second member 3. The envelope 5 is situated close to the end of the second member 3.

The envelope 5 contains a discharge medium or fill. Numerous fills for microwave electrodeless lamps are known in the art and may be used in conjunction with this invention. The choice of fill materials depends primarily on the desired spectrum of radiation to be obtained. Exact fill formulas in terms of moles per cubic centimeter are known in the art. See, for example, U.S. Pat. Nos. 4,501,933 to Mueller et al and 4,859,906 to Ury et al which teach fills for microwave lamps.

Conduit means 7 is provided to force a jet of cooling gas against envelope 5. Only two conduits 7 are shown in the interest of preserving the clarity of the drawing; however, additional conduits, such as will provide, for example, a lamp containing four cooling jets equally spaced about envelope 5 aimed at different latitudes of the envelope is preferred. In order to further improve the uniformity of cooling, the envelope may be rotated by a motor connected to the stem 4 via a hole in end 6.

A slot-shaped coupling iris 69 is established with its longitudinal axis parallel to the axis of the cavity 1 on the cylindrical wall of the first member 2 of the cavity. A waveguide 70 is connected to the exterior of the first member 2 over the coupling iris 69. A magnetron 11 (not shown) is coupled to the waveguide 70. Arrangements for coupling magnetrons to waveguides and waveguides to cavities as referred to above are well-known.

An external reflector 8 is established about the cavity so as to collect and direct the light emanating from the envelope 5. The reflector is preferably aluminum and could be formed, for example, by spinning, casting, machining or electroforming.

According to the invention a reflector 21 made of a non-conductive material is established inside lamp cavity 1. While reflector 21 is preferably made of a glass-like material such as quartz or Pyrex, other materials such as ceramics or other suitable non-conductive materials known in the art can also be used. The material chosen for the non-conductive reflector preferably has a low loss tangent so that it does not dissipate microwave energy in the cavity. Additionally it should have a low dielectric constant so that it does not greatly modify the electromagnetic fields in the cavity.

The stem 4 of the bulb passes through a hole 12 in the non-conductive reflector 21.

Pyrex and glass are not highly reflective, so if they are used they should be provided with reflective coatings. Preferably the reflective coating used is of the dichroic, dielectric interference type. Such coatings comprise alternating layers of low and high index materials, each of which preferably has an optical thickness of about ¼ of the wavelength of the light which it is desired to reflect. Silicon dioxide is suitable for use as the low index of refraction material, while zirconium dioxide, titanium dioxide, hafnium dioxide, and tantalum dioxide can be used as the high index of refraction material. These materials are given as examples, and other reflective coating materials are known and could be used.

The coating are generally applied by electron beam evaporation or sputtering techniques. The design and formation of such coatings are known.

Glass-like materials are usually smooth enough to so that the reflector will be specular, which is preferred. A specular reflector allows more strict control of the reflected light. Alternatively the reflector could be roughened so that the reflector would be diffuse. A diffuse reflector is useful in providing flood illumination.

The shape of the non-conductive reflector 21 typically is complementary to the shape of external reflector 8, and may function like a continuation of the external reflector. Alternatively, the non-conductive reflector 21 could be markedly different in shape, yet be designed to work with the external reflector so that the whole optical system provides desired optical characteristics such as uniformity, collimation, high peak intensity, etc. In general, the shape of internal reflector 21 can be varied substantially to suit optical considerations, and since it is non-conductive, at most only minor retuning of the microwave system will be needed to compensate for the changes.

By way of example, the non-conductive reflector may be cone-shaped with its virtual apex either facing the envelope 5 or away from it, or it may be spherical, centered on the bulb. The reflector may be ellipsoidal or paraboloidal with the envelope 5 located at the focus of reflector 21. An ellipsoidal reflector concentrates light at a spot, while a parabolic reflector collimates light. It may comprise concentric annular facets each of which is designed having a size and orientation such that the sum of the light reflected from all of the facets gives a desired illumination pattern.

Non-conductive reflector 21 may be comprised of a plurality of pieces, including an outer piece which may be notched along its outer periphery to accommodate protrusions into the cavity such as for conduit 69 if reflector 21 is placed at that level. An inner piece could be made small enough to fit through a hole in the solid member 2 when end 6 is removed. Other reasons such as optical considerations may arise for designing the non-conductive reflector in a plurality of pieces.

The non-conductive reflector 21 is preferably affixed to the stem 4 at the hole 12 and rotates with the stem. This arrangement facilitates removal of envelope 5 by removal of the end 6 of the solid cup-like member 2, since envelope 5 does not have to slip through the hole 12 in the non-conductive reflector. Preferably, the non-conductive reflector 21 is adhered to the bulb stem 4 by an adhesive such as a silicone rubber cement, an ultraviolet curable polymer, or a high temperature inorganic, e.g., a ceramic cement.

Alternatively, the non-conductive reflector 21 may be adhered or attached by mechanical means to the solid cup-like member 2. In this case the mesh part 3 would have to be removed in order to remove envelope 5.

The foregoing description is intended to illustrate rather than limit the present invention which can readily be modified by workers skilled in the art without departing from the scope thereof.

We claim:

1. A microwave powered lamp comprising:

a microwave cavity having a wall which is transparent to optical radiation;

means for coupling microwave energy to said cavity;

a discharge envelope mounted within said cavity;

reflector means for reflecting light emitted from said cavity mounted external to said cavity; and, non-conductive reflector means mounted within said cavity for reflecting light outwardly from said cavity.

2. A microwave powered lamp comprising:

a source of microwave power;

a cylindrical microwave cavity, said cavity having an axis defined by a first cup-shaped member having solid cylindrical walls and a second cup-shaped member having cylindrical mesh walls adapted to retain microwaves and pass light;

coupling means mounted on said first cup-shaped member for coupling microwave energy from said source of microwave power to said cavity;

a discharge envelope mounted within said cavity on the axis thereof;

rotationally symmetrical first reflector means mounted outside said cavity for reflecting light emitted from said envelope, said first reflector means having an axis substantially coincident with the axis of said cavity; and, non-conductive second reflector means mounted within said cavity for reflecting light toward said second cup-shaped member.

3. A lamp according to claim 2, wherein said non-conductive second reflector means comprises a glass-like material selected from the group consisting of quartz and Pyrex.

4. A lamp according to claim 2, wherein said non-conductive second reflector means is rotationally symmetrical about an axis coincident with the axis of said rotationally symmetrical first reflector means.

5. A lamp according to claim 2, wherein the dimensions of said cavity support a $TE_{111}$ mode of microwave oscillation at a frequency of operation of said cavity.

6. A lamp according to claim 5, wherein said frequency of oscillation is about 2.45 GHz.

7. A lamp according to claim 2, wherein said coupling means comprises a coupling slot.

8. A lamp according to claim 7, wherein said coupling slot is parallel to an axis of said cylindrical cavity on a cylindrical wall of said cylindrical cavity.

9. A microwave electroless lamp comprising:

a microwave generator;

a microwave cavity;

means for coupling microwave energy from said microwave generator to said cavity;

an electrodeless discharge envelope disposed in said cavity, said envelope containing a discharge fill;

a reflector mounted external to said cavity for reflecting light emitted by said envelope; and, a non-conductive reflector mounted internal to said cavity for reflecting light outwardly from said cavity.

* * * * *